US005975640A

United States Patent [19]

Chen

[11] Patent Number: 5,975,640

[45] Date of Patent: Nov. 2, 1999

[54] ADJUSTABLE ARMREST OF AN OFFICE CHAIR

[76] Inventor: Chao Ken Chen, No. 15-1, Fu-Kung Rd., Chung Hua Hsien, Taiwan

[21] Appl. No.: 09/136,705

[22] Filed: Aug. 19, 1998

[30] Foreign Application Priority Data

Aug. 22, 1997 [TW] Taiwan ..... 86214322

[51] Int. Cl.[6] ..... A47C 7/54

[52] U.S. Cl. ..... 297/411.37; 297/411.35; 297/411.31

[58] Field of Search ..... 297/411.31, 411.35, 297/411.37, 411.38; 248/118, 118.1, 282.1

[56] References Cited

U.S. PATENT DOCUMENTS 5,655,814 8/1997 Gibbs ..... 297/411.38
5,848,823 12/1998 Su ..... 297/411.37
5,876,097 3/1999 Cao ..... 297/411.37
5,884,976 3/1999 Breen et al. ..... 297/411.37

*Primary Examiner*—Laurie K. Cranmer
*Attorney, Agent, or Firm*—Pro-Techtor International Services

[57] ABSTRACT

Adjustable armrest including an armrest holder frame, a bottom plate fixedly fastened to the armrest holder frame, a first movable plate having a front end pivoted to one end of the bottom plate and a rear end, a second movable plate having one end pivoted to the rear end of the first movable plate, an elastomer block fixedly mounted on the second movable plate at the top, an armrest pad pivoted to the second movable plate and supported on the elastomer block and forced to oscillate back and forth, first lock means adapted to lock and first movable plate and the bottom plate in a received position where the first movable plate and the bottom plate are vertically arranged in a stack; and second lock means adapted to lock the first movable plate and second movable plate in a received position where the second movable plate and the first movable plate are vertically arranged in a stack.

8 Claims, 5 Drawing Sheets

Prior Art. Fig. 1

Prior Art. Fig. 2

ADJUSTABLE ARMREST OF AN OFFICE CHAIR

BACKGROUND OF THE INVENTION

The present invention relates to an adjustable armrest of an office chair, and more particularly to such an adjustable armrest which comprises an armrest coupled to a bottom plate on an armrest holder frame through two pivoted movable plates, and lock means adapted to lock the armrest in a received manner.

Regular office chairs are commonly equipped with fixed armrests for resting the arms. However, these fixed armrests cannot be adjusted to different positions as desired. FIGS. 1 and 2 show an adjustable armrest structure for office chairs. This adjustable armrest structure comprises a bottom plate 11 fixedly mounted on an armrest holder frame 1, a first movable plate 12 pivoted to one end of the bottom plate 11 by a pivot and axle bearing unit 17, a second movable plate 13 pivoted to one end of the first movable plate 12 remote from the bottom plate 11 by a pivot and axle bearing unit 16, and an armrest pad 14 having two downward parallel lugs 15 bilaterally pivoted to the second movable plate 13. The bottom plate 11, the first movable plate 12 and the second movable plate 13 have a respective locating hole 111; 121; 131. When the armrest is received in a received condition as shown in FIG. 2, a lock pin 18 is fastened to the locating holes 111; 121; 131 to fix the bottom plate 11, the first movable plate 12 and the second movable plate 13 in a stack. This structure of adjustable armrest has drawbacks. Because the axle bearings of the pivot and axle bearing units 16; 17 are ball bearings, the first movable plate 12 and the second movable plate 13 tend to be forced away from the received position to the extended position, therefore the operator's hands tend to be jammed in parts of the adjustable armrest. Another drawback of this structure of adjustable armrest is that the complicated locking procedure of aligning the locating holes 111; 121; 131 and fastening the lock pin 18 to the locating holes 111; 121; 131. Still another drawback of this structure of adjustable armrest is that the lock pin 18 tends to fall from the locating holes 111; 121; 131, thereby causing the adjustable armrest to be unlocked. Furthermore, when the user inserts the fingers into the gaps between the armrest pad 14 and the second movable plate 13, the fingers may be jammed and injured.

SUMMARY OF THE INVENTION

The present invention has been accomplished to provide an adjustable armrest which eliminates the aforesaid drawbacks. According to one aspect of the present invention, the adjustable armrest comprises an armrest holder frame, a bottom plate fixedly fastened to the armrest holder frame, a first movable plate having a front end pivoted to one end of the bottom plate by a pivot and a rear end, a second movable plate having one end pivoted to the rear end of the first movable plate by a pivot, an elastomer block fixedly mounted on the second movable plate at the top, an armrest pad pivoted to the second movable plate and supported on the elastomer block and forced to oscillate back and forth, first lock means adapted to lock and first movable plate and the bottom plate in a received position where the first movable plate and the bottom plate are vertically arranged in a stack; and second lock means adapted to lock the first movable plate and second movable plate in a received position where the second movable plate and the first movable plate are vertically arranged in a stack. According to another aspect of the present invention, needle roller bearings are respectively mounted on the pivots and retained between the bottom plate and the first movable plate, or the first movable plate and the second movable plate, and therefore the second movable plate and the first movable plate do not displace when set in the desired position. According to still another aspect of the present invention, bellows sleeve is mounted on the armrest pad and sleeved onto the elastomer block for protection. According to still another aspect of the present invention, the first lock means comprises a locating device mounted in a locating hole on the bottom plate and turned between a locking position and an unlocking position, and a lock screw mounted in a screw hole on the first movable plate and moved with the first movable plate into engagement with the locating device of the first lock means to hold the first movable plate and the bottom plate in the received position after the locating device of the first lock means has been turned to the locking position; the second lock means comprises a locating device mounted in a locating hole on the first movable plate and turned between a locking position and an unlocking position, and a lock screw mounted in a screw hole on the second movable plate and moved with the second movable plate into engagement with the locating device of the second lock means to hold the first movable plate and second movable plate in the received position after the locating device of the second lock means has been turned to the locking position.

DETAILED DESCRIPTION OF THE PREFERRED EMBODIMENT

Figure 1:
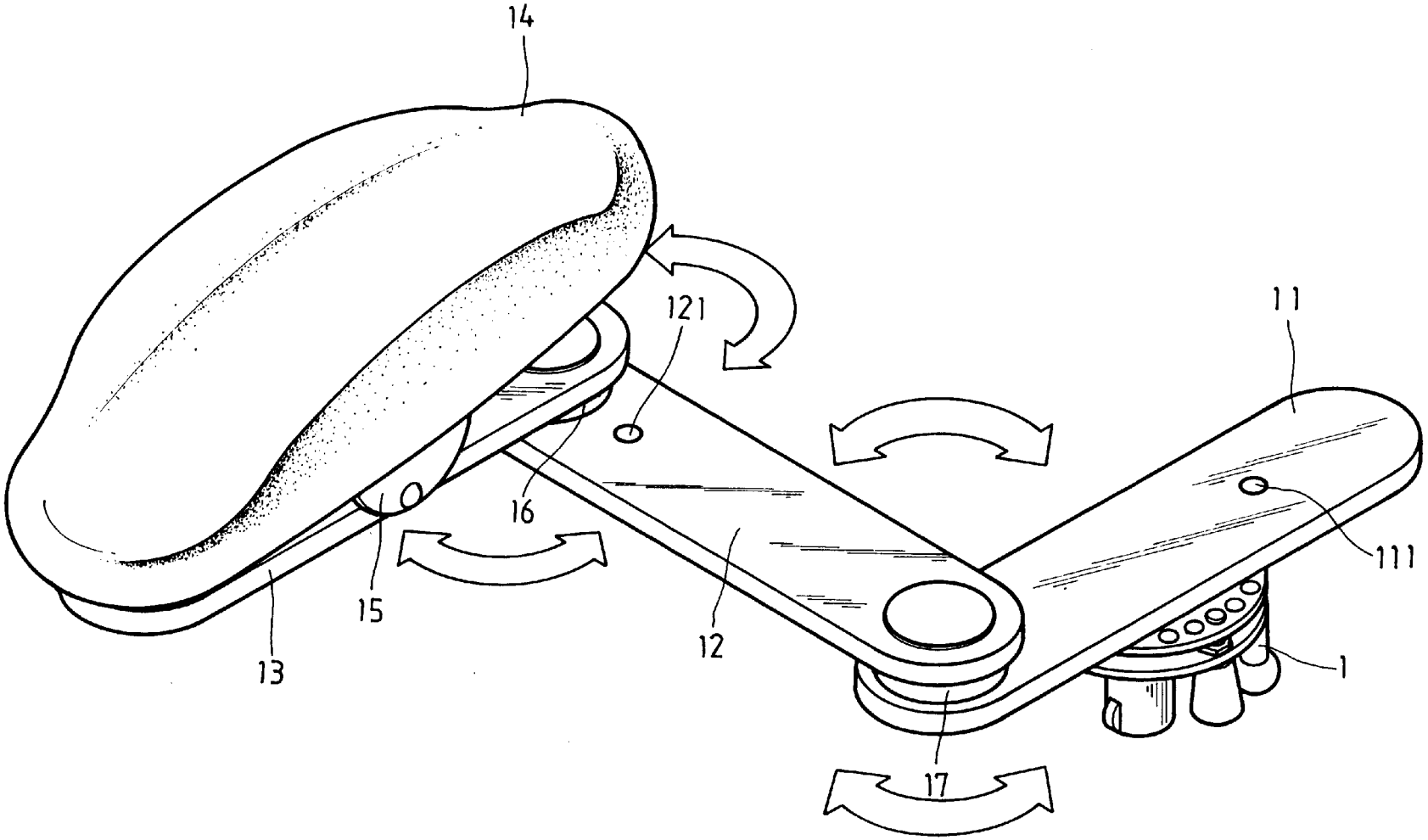
FIG. 1 shows an adjustable armrest according to the prior art.
Figure 2:
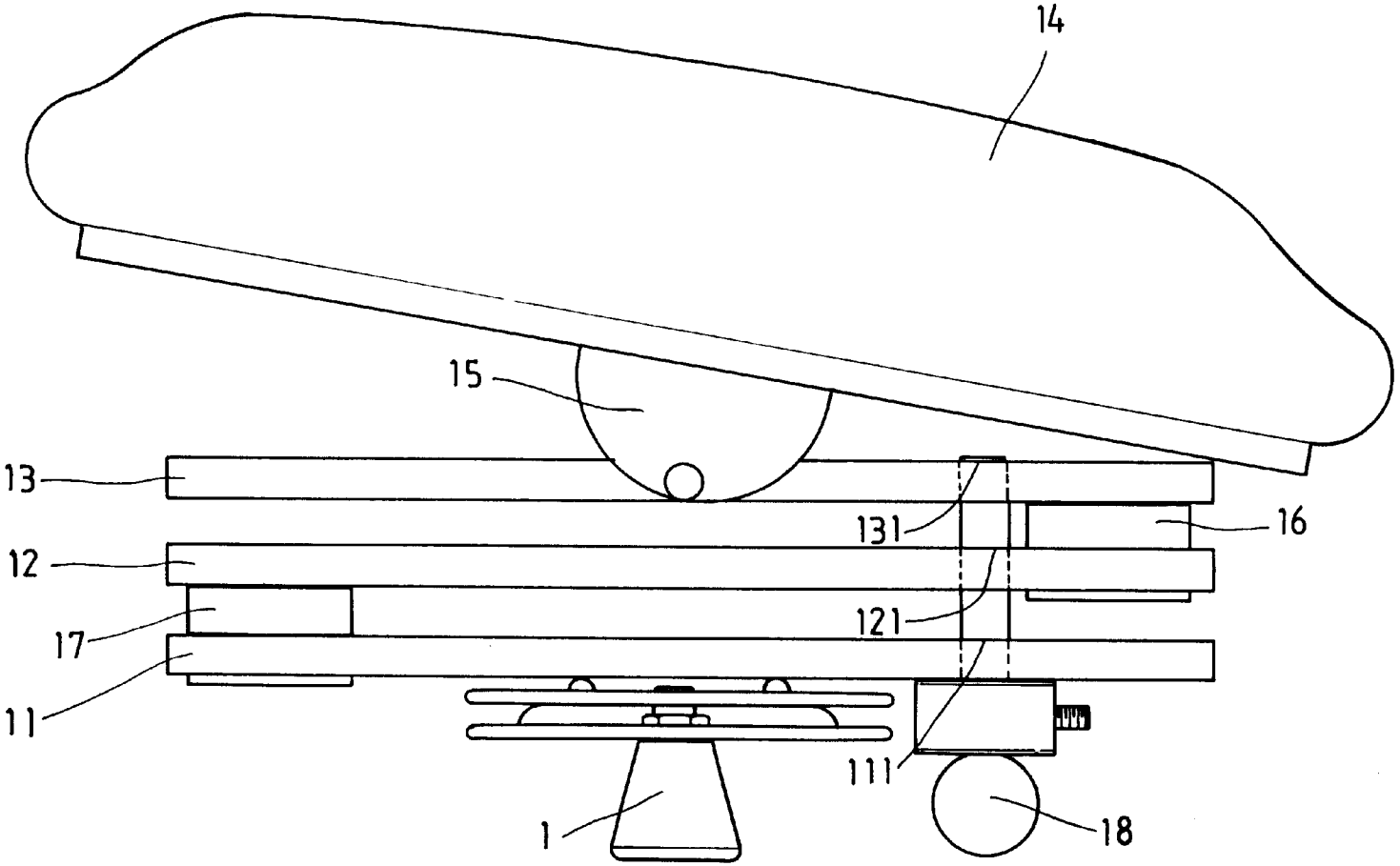
FIG. 2 is a side view of the adjustable armrest shown in FIG. 1 when received and locked.
Figure 3:
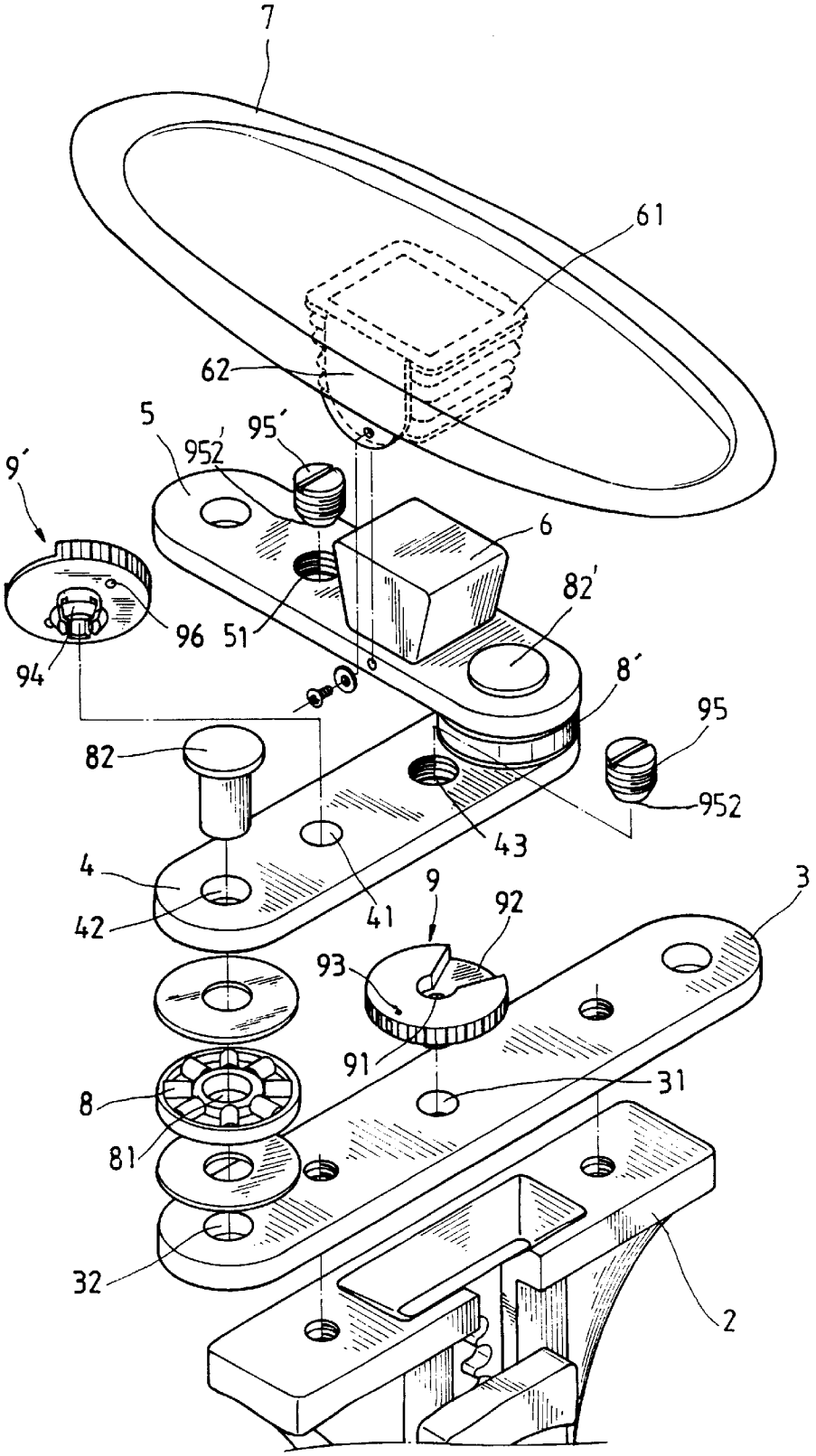
FIG. 3 is an exploded view of an adjustable armrest according to the present invention.

Referring to FIG. 3, an adjustable armrest in accordance with the present invention is generally comprised of an armrest holder frame 2, a fixed bottom plate 3, a first movable plate 4, a second movable plate 5, an elastomer block 6, an armrest pad 7, a first needle roller bearing 8, a second needle roller bearing 8', a first locating device 9, a second locating device 9', a first lock screw 95, and a second lock screw 95'.

Figures 5, 5A, 5B:
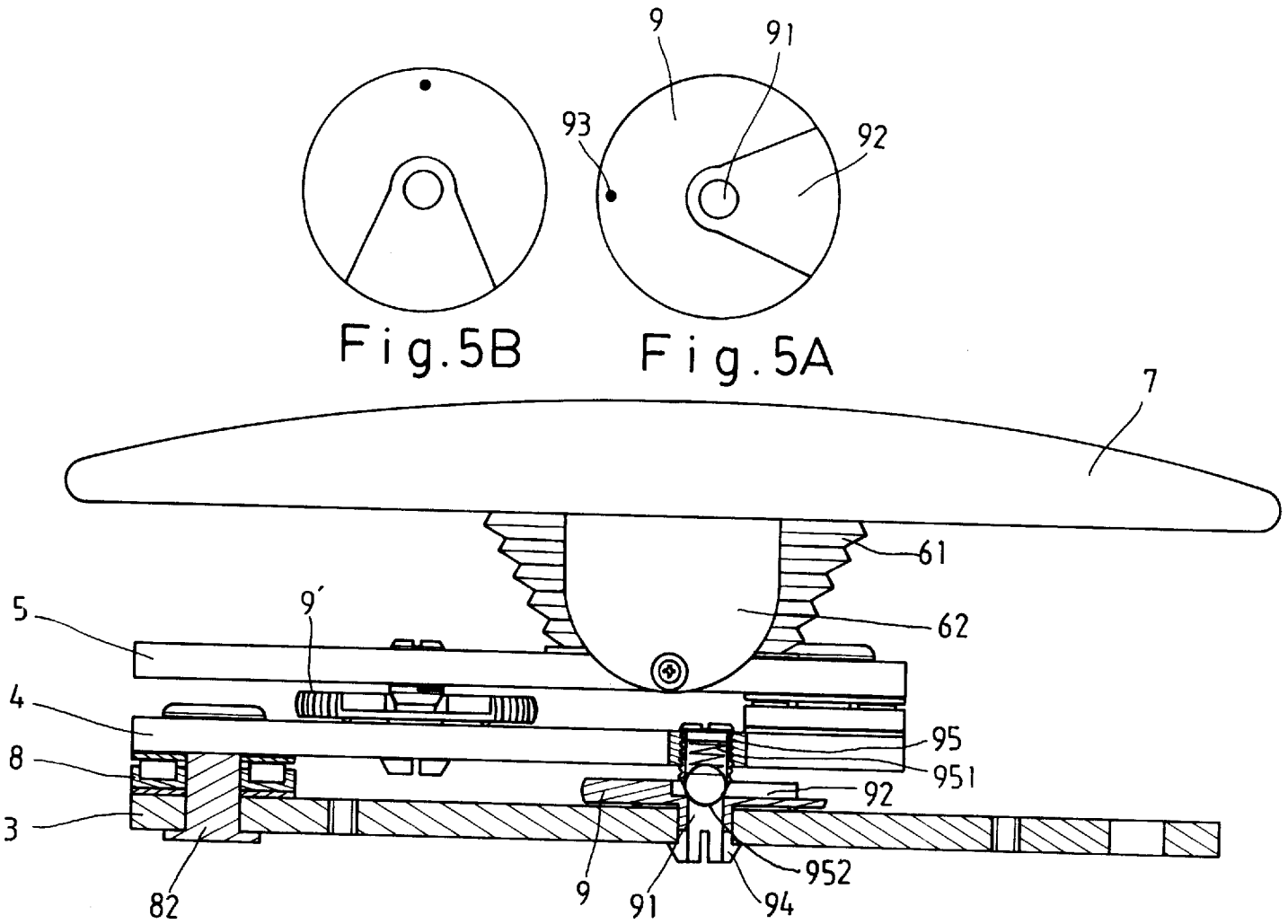
FIG. 5 is a side view in an enlarged scale of FIG. 4A.
FIG. 5A is a top view in an enlarged scale of the first locating device according to the present invention.
FIG. 5B is similar to FIG. 5A but showing the angular position of the locating device changed.

Referring to FIGS. 5, 5A and 5B, and FIG. 3 again, the bottom plate 3 is fixedly fastened to the armrest holder frame 2 at the top by rivets 33, having a locating hole 31 in the middle adapted to receive the first locating device 9, and a pivot hole 32 at one end. The first movable plate 4 has a first pivot hole 42 at one end pivotably connected to the pivot hole 32 of the bottom plate 3 by a first pivot 82, a second pivot hole (not shown) at an opposite end, a locating hole 41 spaced between the first pivot hole 42 and the second pivot hole, and a screw hole 43 spaced between the locating hole 41 and the second pivot hole. The first needle roller bearing 8 is mounted around the first pivot 82 and retained between the first movable plate 4 and the bottom plate 3, having a center through hole 81 which receives the first pivot 82. The second movable plate 5 has a pivot hole (not shown) at one end pivotably connected to the second pivot hole of the first movable plate 4 by a second pivot 82', and a screw hole 51 in the middle. The second needle roller bearing 8' is mounted around the second pivot 82' and retained between the first movable plate 4 and the second movable plate 5. The first locating device 9 and the second locating device 9' are respectively mounted in the locating hole 31 of the bottom plate 3 and the locating hole 41 of the first movable plate 4. The elastomer block 6 is fixedly mounted on the second movable plate 5 and adapted to support the armrest pad 7. The armrest pad 7 has two downward coupling plates 62 bilaterally raised from its bottom side and respectively pivoted two opposite sides of the second movable plate 5, and a bellows sleeve 61 raised from its bottom side between the downward coupling plates 62 and sleeved onto the spring member 6. The locating devices 9 have each a plurality of smoothly curved raised portions 93; 96 at top and bottom sides thereof, a center locating hole 91, a downward split coupling rod 94 at the bottom pivotably coupled to the locating hole 31 or 41, and a sector recess 92 at the top side extended from the respective center locating hole 91 to the periphery. The first lock screw 95 and the second lock screw 95' are respectively mounted in the screw hole 43 of the first movable plate 4 and the screw hole 51 of the second movable plate 5, having a respective hollow structure. Each lock screw 95 or 95' holds a respective spring 951 and a respective steel ball 952. The steel ball 952 is fixedly connected to one end of the spring 951 and partially projecting out of the hollow bottom end of the lock screw 95 or 95'.

Figures 4, 4A:
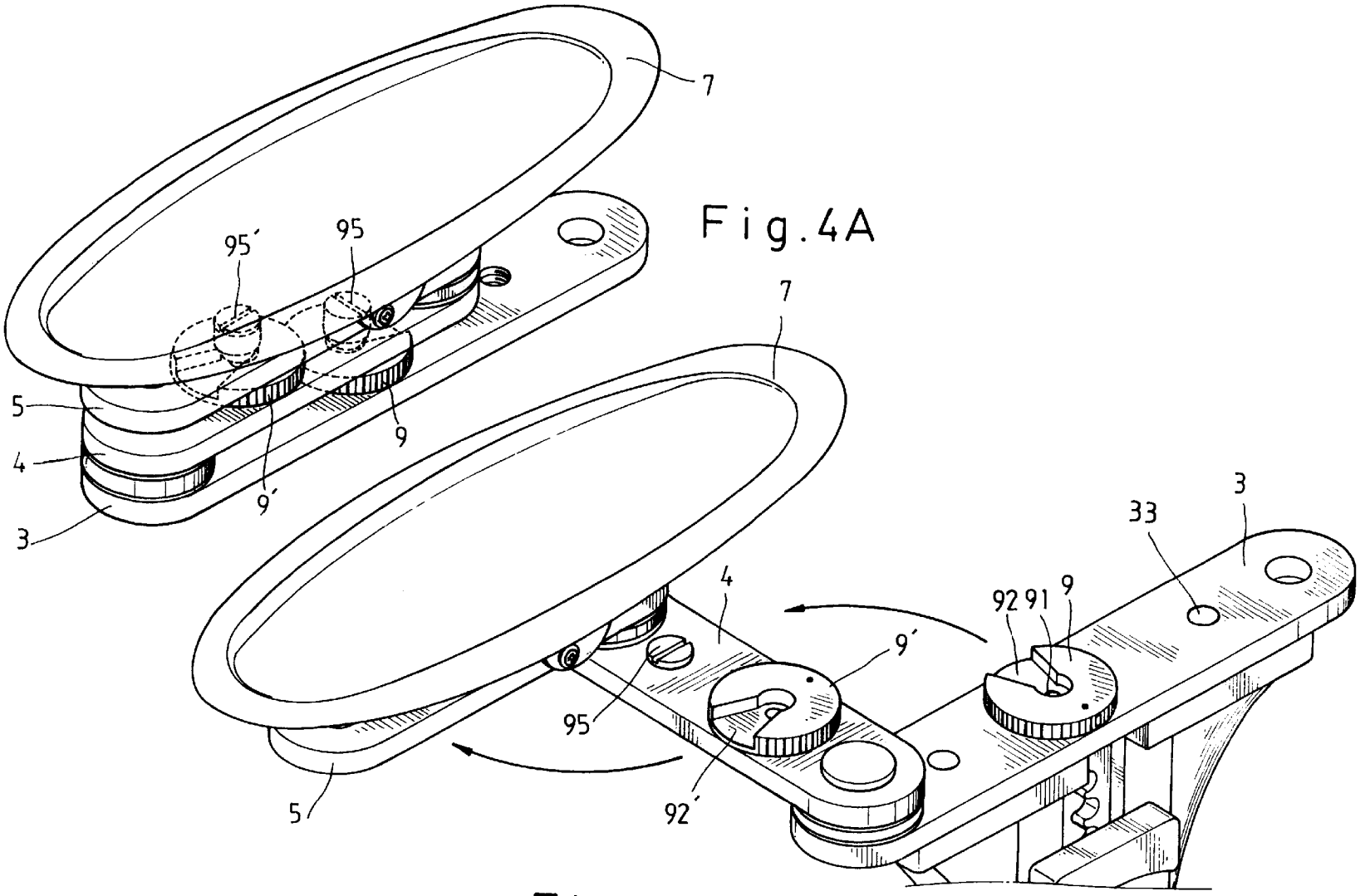
FIG. 4 is an applied view of the present invention, showing the first movable plate extended out of the bottom plate, the second movable plate extended out of the first movable plate.
FIG. 4A is a perspective view of the present invention, showing the adjustable armrest arranged in the received condition.

Referring to FIGS. 4 and 4A, and FIGS. from 3 to 5 again, when the first movable plate 4 and the second movable plate 5 are respectively turned about the first pivot 82 and the second pivot 82' and received with the bottom plate 3 into a stack, the steel balls 952; 952' of the lock screws 95; 95' are respectively moved through the sector recesses 92 of the locating devices 9; 9' into engagement with the center locating holes 91 of the locating devices 9; 9', the locating devices 9; 9' are respectively turned in the respective locating holes 31; 41 through an angle to prohibit the steel balls 952; 952' from being moved with the respective lock screws 95; 95' out of the constraint of the locating devices 9; 9', and therefore the armrest is locked in the received manner. On the contrary, when the locating devices 9; 9' are respectively turned in the respective locating holes 31; 41 in the reversed direction, the steel balls 952; 952' can then be moved with the respective lock screws 95; 95' out of the constraint of the locating devices 9; 9', for permitting the first movable plate 4 and the second movable plate 5 to be respectively extended out. Furthermore, because the top and bottom sides of the locating devices 9; 9' are respectively disposed in contact with the top side of the bottom plate 3 and the bottom side of the first movable plate 4, or the top side of the first movable plate 4 and the bottom side of the second movable plate 5 by the respective raised portions 93; 96, less friction resistance is produced when turning the first movable plate 4 relative to the bottom plate 3 or the second movable plate 5 relative to the first movable plate 4.

While only one embodiment of the present invention has been shown and described, it will be understood that various modifications and changes could be made thereunto without departing from the spirit and scope of the invention disclosed.

What the invention claimed is:

1. An adjustable armrest comprising:

an armrest holder frame;

a bottom plate fixedly fastened to a top side of said armrest holder frame, said bottom plate comprising a pivot hole at one;

a first movable plate having a first pivot hole at one end and a second pivot hole at an opposite end;

first pivot means fastened to the pivot hole of said bottom plate and the first pivot hole of said first movable plate for permitting said first movable plate to be turned about said first pivot means relative to said bottom plate;

a second movable plate having a pivot hole at one end;

second pivot means fastened to the pivot hole of said second movable plate and the second pivot hole of said second movable plate for permitting said second movable plate to be turned about said second pivot means relative to said first movable plate;

an elastomer block fixedly mounted on a top side of said second movable plate in the middle;

an armrest pad pivoted to said second movable plate at a top side and supported on said elastomer block and forced to oscillate back and forth;

a first needle roller bearing mounted around said first pivot means and supported between said bottom plate and said first movable plate;

a second needle roller bearing mounted around said second pivot means and supported between said first movable plate and said second movable plate;

first lock means adapted to lock and first movable plate and said bottom plate in a received position where said first movable plate and said bottom plate are vertically arranged in a stack; and second lock means adapted to lock said first movable plate and second movable plate in a received position where said second movable plate and said first movable plate are vertically arranged in a stack; and wherein said first lock means comprises a locating device mounted in a locating hole on said bottom plate and turned between a locking position and an unlocking position, and a lock screw mounted in a screw hole on said first movable plate and moved with said first movable plate into engagement with the locating device of said first lock means to hold said first movable plate and said bottom plate in the received position after the locating device of said first lock means has been turned to the locking position; said second lock means comprises a locating device mounted in a locating hole on said first movable plate and turned between a locking position and an unlocking position, and a lock screw mounted in a screw hole on said second movable plate and moved with said second movable plate into engagement with the locating device of said second lock means to hold said first movable plate and second movable plate in the received position after the locating device of said second lock means has been turned to the locking position.

2. The adjustable armrest of claim 1 wherein the locating devices of said first lock means and said second lock means comprise a respective split coupling rod at a bottom side respectively coupled to the locating holes of said bottom plate and said first movable plate, a respective center locating hole adapted to receive the respective lock screw in the locking position, and a respective recess extended from the respective center locating hole to the periphery through which the respective lock screw is moved between the locking position and the unlocking position.

3. The adjustable armrest of claim 2 wherein the recesses of the locating devices of said first lock mean said second lock means have a width gradually increasing toward the periphery.

4. The adjustable armrest of claim 3, wherein the recesses of the locating devices of said first lock means and said lock means are shaped like a sector.

5. The adjustable armrest of claim 1, wherein the locating devices of said first lock means and said second lock means have a plurality of smoothly curved raised portions at top and bottom sides.

6. The adjustable armrest of claim 1, wherein said elastomer block is a trapezoidal block.

7. The adjustable armrest of claim 1, wherein said armrest pad has a bellows sleeved at a bottom side sleeved onto said elastomer block.

8. The adjustable armrest of claim 1, wherein the lock screws of said first lock means and said second lock means have a respective bottom hole, a respective spring mounted in the respective bottom hole, and a respective steel ball fixedly fastened to the respective spring and partially projecting out of the respective bottom hole and adapted for engaging the center locating hole of the respective locating device.

* * * * *